United States Patent [19]

Marschman et al.

[11] Patent Number: 4,871,437

[45] Date of Patent: Oct. 3, 1989

[54] CERMET ANODE WITH CONTINUOUSLY DISPERSED ALLOY PHASE AND PROCESS FOR MAKING

[75] Inventors: Steven C. Marschman; Norman C. Davis, both of Richland, Wash.

[73] Assignee: Battelle Memorial Institute, Richland, Wash.

[21] Appl. No.: 116,475

[22] Filed: Nov. 3, 1987

[51] Int. Cl.[4] ..... C25B 11/04

[52] U.S. Cl. ..... 204/291; 204/292; 204/293; 252/518; 252/519; 252/521; 428/568; 75/234; 75/246; 75/247; 148/132; 148/14; 148/134; 148/414; 419/19; 419/38; 419/45; 419/54

[58] Field of Search ..... 75/230, 232, 234, 246, 75/247; 148/18.1, 13.2, 14, 134, 414; 204/64 R, 291, 292, 923, 243 R; 252/512, 513, 518, 519, 521; 428/567, 568, 414; 419/19, 32, 38–39, 44, 46, 54, 57

[56] References Cited

U.S. PATENT DOCUMENTS

| | | | |
|---|---|---|---|
| 4,374,050 | 2/1983 | Ray | 252/519 |
| 4,374,761 | 2/1983 | Ray | 252/519 |
| 4,399,008 | 8/1983 | Ray | 204/67 |
| 4,430,189 | 2/1984 | Clark et al. | 204/290 R |
| 4,455,211 | 6/1984 | Ray et al. | 204/293 |
| 4,462,889 | 7/1984 | Landon et al. | 204/292 |
| 4,478,693 | 10/1984 | Ray | 204/64 R |
| 4,484,997 | 11/1984 | Secrist et al. | 204/243 R |
| 4,529,494 | 7/1985 | Joo' et al. | 204/290 R |
| 4,541,912 | 9/1985 | Secrist et al. | 204/290 R |
| 4,544,457 | 10/1985 | Sane et al. | 204/67 |
| 4,560,448 | 12/1985 | Sane et al. | 204/67 |
| 4,582,585 | 4/1986 | Ray | 204/243 R |
| 4,600,481 | 7/1986 | Sane et al. | 204/67 |
| 4,614,569 | 9/1986 | Duruz et al. | 204/67 |
| 4,620,905 | 11/1986 | Tarcy et al. | 204/64 R |
| 4,680,094 | 7/1987 | Duruz | 204/67 |

*Primary Examiner*—John F. Niebling
*Assistant Examiner*—Kathryn Gorgos
*Attorney, Agent, or Firm*—Wells, St. John & Roberts

[57] ABSTRACT

Cermet electrode compositions and methods for making are disclosed which comprise Ni-O—$NiFe_2O_4$—Cu—Ni. Addition of an effective amount of a metallic catalyst/reactant to a composition of a nickel/iron/oxide, NiO, copper, and nickel produces a stable electrode having significantly increased electrical conductivity. The metallic catalyst functions to disperse the copper and nickel as an alloy continuously throughout the oxide phase of the cermet to render the electrode compositon more highly electrically conductive than were the third metal not present in the base composition. The third metal is preferably added to the base composition as elemental metal and includes aluminum, magnesium, sodium and gallium. The elemental metal is converted to a metal oxide during the sintering process.

24 Claims, No Drawings

CERMET ANODE WITH CONTINUOUSLY DISPERSED ALLOY PHASE AND PROCESS FOR MAKING

TECHNICAL FIELD

This invention relates to cermet electrodes for use in the electroytic reduction of a metal from a metal compound dissolved in a molten salt. The invention has specific application in the production of anodes and the electrolytic process for manufacture of aluminum in Hall-Heroult cells.

BACKGROUND OF THE INVENTION

This invention was made with government support under Contract No. DE-AC06-76RLO 1830 awarded by the U.S. Department of Energy. The government has certain rights in the invention.

Electrolytic cells, such as a Hall-Heroult cell for aluminum production by the electrolysis of alumina in molten cryolite, conventionally employ conductive carbon electrodes. The Hall-Heroult process reduces aluminum metal from alumina in a molten salt electrolyte and consumes carbon from a carbon anode in the process. The anode liberates oxygen from the alumina, which results in aluminum metal being collected on the cathode. The oxygen combines with carbon to produce CO and $CO_2$. The overall reaction in its simplest form is represented as follows:

$$2\,Al_2O_3 + 3\,C \xrightarrow[Na_3AlF_6]{940°-1000°\,C.} 4\,Al + 3\,CO_2$$

Approximately 0.33 pounds of carbon are consumed for every pound of aluminum produced. The life of carbon anodes is typically two to three weeks.

Carbon obtained from petroleum coke is typically used for fabrication of such anodes. Such material is becoming increasingly expensive. The petroleum coke also typically contains significant quantities of impurities such as sulfur, silicon, vanadium, titanium, iron and nicke. Such impurities can contaminate the metal being produced as well as cause environmental problems and poor working conditions. Removal of excess quantities of such impurities requires extra and costly steps when high purity aluminum is to be produced.

If no carbon were consumed in the reduction of alumina, the overall reaction would be: $2Al_2O_3 \rightarrow 4Al + 3O_2$. Accordingly, non-consumable anodes could be used in a process where carbon does not enter into the electrolytic reaction. Such anodes would have a life limited only by corrosion due to the caustic cryolite electrolyte and electrochemical degradation mechanisms. It is anticipated that the life of such anodes could be extended to several months or even a year or more as compared to the two to three week life of a carbon anode which is consumed in the electrolytic reduction reaction. Furthermore, non-consumable anodes would presumably not add the same significant quantities of impurities as do carbon anodes.

Numerous attempts have been made to develop an inert electrode, but apparently without the required degree of success to make it commercially feasible. The entire aluminum industry still uses consumable carbon anodes in the production of aluminum. Many of the newly developed inert electrodes apparently are reactive or corroded by the electrolyte to an extent which results in contamination of the metal being produced as well as consumption of the anode due to corrosion.

There have been numerous suggestions for non-consumable anode compositions based on various ceramic oxides and oxy compounds. Such materials typically behave as a semi-conductor having inherently low electrical conductivities on the order of 1 ohm $^{-1}$cm$^{-1}$. (All electrical conductivities referred to in this document related to conductivity at normal cell operating temperatures of 900° C. to 1,000° C.) Attempts have been made to fabricate non-consumable electrodes with special compositions known as cermets. A cermet composition includes both metallic and ceramic phases. Cermets typically have higher electrical conductivity than pure ceramic compositions, and improved corrosion resistance as compared to metals. The conventional method of preparing cermet compositions is to mix metal and ceramic powders. cold press a preform, and sinter the preform at an elevated temperature in a controlled atmosphere. Alternatively, the cermet can be prepared by hot pressing or hot isostatic pressing wherein the sintering operation is carried out under pressure. Other densification methods for forming oxides and metals into cermets may also be usable.

One promising oxide system identified for use with cermets is the $NiO\text{-}NiFe_2O_4$ system. However, most cermets using this oxide system, or other oxide systems, still have low electrical conductivities, on the order of 1 to 10 ohm$^{-1}$cm$^{-1}$. Prior art oxide systems containing nickel in the metal phase (a $NiO\text{-}NiFe_2O_4$-Ni cermet) have been fabricated by reaction sintering processes and exhibit excellent electrical conductivity on the order of 300 ohm$^{-1}$cm$^{-1}$. This is even an improvement over the conductivity of carbon anodes which typically average approximtely 200 ohm$^{-1}$cm$^{-1}$. However, typical cermets have a discontinuous metal phase distributed throughout the oxide phase and are susceptible to anodic dissolution by corrosion. This causes anodes of such material to fail prematurely and also contaminate the produced aluminum with nickel.

Copper has also been incorporated into the $NiO\text{-}NiFe_2O_4$ matrix creating an $NiO\text{-}NiFe_2O_4$-Cu cermet. The Cu metal phase is discontinuously distributed within the oxide matrix, but still provides improved electrical conductivity on the order of 60 to 70 ohm$^{-1}$cm$^{-1}$. Such a material had a copper content of 17 weight percent.

For example, U.S. Pat. No. 4,620,905 to Tarcy et al. discloses an $NiO\text{-}NiFe_4O_4$-Cu-Ni cermet wherein 17% of the composition is comprised of a metal alloy of copper and nickel. The nickel metal is understood to arise primarily from the reduction of excess NiO in the oxide phase induced by the presence of carbon-based binders used to produce the oxide powders (col. 5, lines 3–14).

U.S. Pat. Nos. 4,374,761; 4,478,693; 4,399,008; and 4,374,050 to Ray and 4,455,211 to Ray et al. also disclose non-consumable cermet electrodes for use in molten salt electrolysis. The electrodes disclosed are stated to be comprised of ceramic oxide compositions having at least one metal powder disbursed therethrough for purposes of increasing electrical conductivity. The metal powder is stated to be selected from the group consisting of Co, Fe, Ni, Cu, Pt, Rh, In, and Ir or alloys thereof. The metal is also stated to be provided in the electrode composition in amounts not constituting more than 30 volume percent metal. Additionally, elemental copper is stated to be includable in an amount up to 30 weight percent of the finished composition using the Ray processes. However, no example in any of these patents supports the broad statements concerning achieving high metal content in a cermet. Further, the metal is indicated as being coated with a wax binder to prevent the metal particles from oxidizing during the sintering step. Additionally, the electrical conductivities of the example electrodes range from 0.4 $ohm^{-1}cm^{-1}$ to 32 $ohm^{-1}cm^{-1}$.

Prior to the present invention, 17% metal alloy of copper and nickel was understood to be at or close to the practical upper limit of including an alloy of copper and nickel or pure copper within a $NiO\text{-}NiFe_2O_4$ oxide system, despite statements in the above prior art patents. Apparently in these processes, additions of copper above this limit merely bled out of the composite during sintering, forming small copper metal beads on the surface of the cermet. Further, the alloy phase is discontinuously distributed throughout the oxide phase.

DETAILED DESCRIPTION OF PREFERRED EMBODIMENTS

The following disclosure of the invention is submitted in compliance with the constitutional purpose of the Patent Laws "to promote the progress of science and useful arts" (Article 1, Section 8).

It has been discovered that addition of an effective amount of a metallic catalyst/reactant to a base composition of a nickel/iron/oxide, NiO, copper, and nickel provides a stable electrode having significantly increased electrical conductivity. The metallic catalyst/reactant functions to disperse the copper and nickel as an alloy continuously throughout the oxide phase of the cermet to render the electrode composition more highly electrically conductive than were the third metal not present in the base composition. The third metal is preferably added to the base mixture as elemental metal in micronized form which is converted to a metal oxide during the sintering process. Metallic catalyst/reactants anticipated to be usable in accordance with the invention include aluminum, magnesium, sodium and gallium.

In a preferred process for producing such an electrode, NiO and $NiFe_2O_4$ powders are first combined to provide a mixture having a weight concentration of NiO to $NiFe_2O_4$ preferably from 2:3 to 3:2. Other oxide powder combinations would also be usable, but a combination that produces a $NiO\text{-}NiFe_2O_4$ oxide phase in the finished product is preferred. The $NiO\text{-}NiFe_2O_4$ oxide in this process was a fully reacted, calcined, and spray-dried powder with agglomerates of approximately 50 microns. This was used due to availability, and is of little importance since these agglomerates were broken down to micron size particles during milling. However, small and high surface area particles with a binder provided during spray-drying are considered important in achieving optimum results. The oxide powder combination could also be prepared during milling along with addition of the metals or metal alloy powders, then spray dried to provide the agglomerates to improve powder flowability or packing.

The NiO and $NiFe_2O_4$ mixture is combined with quantities of elemental copper powder and elemental nickel powder with an average particle size of approximately 2 microns. Alternatively, a copper-nickel alloy powder can be combined with the combined oxide powders. The third micronized catalyzing metal is also combined with the other materials to produce a base mixture. Broad concentrations of the base mixture should be from 10 to 30 weight percent copper, 0.1 to 10 weight percent nickel, and from 0.5 to 5.0 weight percent of the third catalyzing metal. The remainder of the mixture consists essentially of $NiO\text{-}NiFe_2O_4$ powder. Preferred concentration ranges are from 20.0 to 30.0 weight percent copper, from 2.0 to 4.0 weight percent nickel, and from 0.5 to 1.5 weight percent of the catalyzing metal.

The base powder mixture is blended by simple shaker-mixing techniques or more preferably, vibrationally milled to more intimately mix the various constituents. Simple blending procedures are typically performed dry. Vibration milling can be used to produce cermets which have a more uniform, homogeneous distribution of the metal phase than possible by using simpler shaker-mixing blending procedures. For vibration milling, stainless steel mixing balls are added to a mixing bottle containing the base powder mixture. A Freon (tm) based liquid solution is preferably used as a milling solution, or the mixture can be milled dry. The Freon (tm) solution functions as a lubricant which volatilizes from the mixture after completion of the milling. The base mixture-solution is vibratory milled from between 0.5 hours to 24 hours and allowed to dry.

The milled base powder mixture is then formed into desired green-body shapes using conventional pressing techniques. The final pressure of the formed mixture will preferably be approximately 25 Kpsi which provides sufficient strength for handling and machining of such green-bodies. The green-bodies are next placed into a sintering furnace having controlled atmosphere capabilities. The furnace preferably has alumina walls as opposed to metal walls which have been shown to cause excessive reduction of nickel and iron from the oxides. The furnace atmosphere is preferably relatively inert containing either argon or nitrogen. Some oxygen is necessary in the range of 100 ppm to 500 ppm, but preferably not higher than 250 ppm to obtain optimum results. The furnace is also preferably ramped to a hold temperature just below the melting point of copper, and held for a period of time up to 50% of the sintering time. The heating rate and hold period allow the alloy to stabilize which contributes to the reduction of metal phase bleedout. This heating cycle is increased to sintering temperatures up to 1300° C. for a holding period of up to 8 hours. This hold time at temperature, as well as heating and cooling down rates, is dependent upon the physical size and mass of the anode being produced.

At the sintering temperatures, the catalyzing metal combines with copper, nickel, NiO, and $NiFe_2O_4$ powders to produce a composition of $NiO\text{-}NiFe_2O_4\text{-}Cu\text{-}Ni$ having Cu and Ni continuously dispersed as an alloy. Where the third catalysting metal is aluminum, the reaction is represented as follows:

$$2\,Al + Ni + Cu + NiFe_2O_4 + (\text{excess})\ Ni_yFe_{1-y}O \rightarrow Ni_yFe_{1-y}O + NiFe_2O_4 + Cu_xNi_{1-x} + Al_2O_3$$

The amount of Fe in $Ni_yFe_{1-y}O$ is typically negligible, resulting in the industry accepted abbreviation NiO. The $Cu_xNi_{1-x}$ alloy phase generated typically also contains a negligible amount of iron. The quantity of $Al_2O_3$ formed in the finished system is also negligible. However, the sintering produces a continuous Cu-Ni alloy phase dispersed throughout the oxide matrix which gives the sintered material metallic properties in terms of electrical conducitivity. Electrical conductivities well in excess of 100 $ohm^{-1}cm^{-1}$ are achievable.

Although the disclosure refers primarily to the combination of NiO with $NiFe_2O_4$, alternate NiO based oxide systems would be usable by skilled artisans without departing from the principles and scope of the invention.

EXAMPLE

An electrode was produced using the above-described process wherein the third catalyzing metal was aluminum. The concentrations in the base powder mixture were as follows:

71 weight percent NiO-$NiFe_2O_4$ powder (spray dried, approximately 50 microns agglomerates)
25 weight percent copper (average 2 micron particles)
3 weight percent nickel (average 3 micron particles)
1 weight percent elemental micronized aluminum.

The base powder mixture was vibratory milled using a Freon (tm) based solution for 2.5 hours. The milled powder was pressed into desired shapes to a final pressure of 25 Kpsi using standard pressing techniques. The sample was slowly heated over a 16 hr period to a diffusion soak temperature below the melting point of copper, (preferably about 1075° C.) and allowed to hold for 2 hours. The sample was then further heated at a rate of approximately 100° C. per hr to a sintering temperature of 1200° C. over a period of 8 hours. Oxygen content in the furnace ranged from 150 to 200 ppm. The remainder of the furnace atmosphere consisted essentially of argon. The sample was maintained under these conditions at 1200° C. for a holding period of an additional 8 hours. The material was then furnace cooled at a rate of approximately 100° C. per hour.

Electrical conductivity of the sample was determined to be in excess of 410 $ohm^{-1}cm^{-1}$ at 950° C. The sample was tested as an anode in a small Hall-Heroult aluminum electrolysis cell. No wear or corrosion was evident after 6 hours of continuous operation at a current density of 1 $A/cm^2$.

In compliance with the statute, the invention has been described in language more or less specific as to structural and methodical features. It is to be understood, however, that the invention is not limited to the specific features described, since the methods herein disclosed comprise a preferred form of putting the invention into effect. The invention is, therefore, claimed in any of its forms or modifications within the proper scope of the appended claims, appropriately interpreted in accordance with the doctrine of equivalents.

We claim:

1. A process for producing an electrically conductive cermet electrode having an oxide phase and an alloy phase for use in the electrolytic reduction of a metal from a metal compound dissolved in a molten salt, the process comprising the following steps:
   combining NiO-nickel/iron/oxide powder with copper and nickel powder to produce a base mixture;
   forming the base mixture into a desired shape;
   sintering the shaped base mixture to produce a desired NiO-nickel/iron/oxide-Cu-Ni cermet having an oxide phase of NiO-nickel/iron/oxide and an alloy phase of Cu-Ni; and
   catalyzing the reaction sintering step by including in the base mixture an effective amount of at least one additional metal which reacts to disperse the copper and nickel continuously throughout the Ni-nickel/iron/oxide oxide phase an an alloy to produce a cermet electrode having higher electrical conductivity than were the additional metal not included in the base mixture, the effective amount of one additional metal being transformed to a metal oxide in the process.

2. The process of claim 1 wherein copper in the alloy phase is present in a weight concentration in excess of 20% of the electrode composition.

3. A cermet electrode produced by the process of claim 2.

4. The process of claim 1 wherein the additional means is selected from the group consisting of aluminum, magnesium, sodium, and gallium.

5. A cermet electrode produced by the process of claim 4.

6. The process of claim 1 wherein the additional metal comprises aluminum.

7. A cermet electrode produced by the process of claim 6.

8. The process of claim 1 wherein,
   copper is present in a base mixture weight concentration of from 10% to 30%;
   nickel is present in a base mixture weight concentration of from 0.1% to 10%;
   the additional metal is present in a base mixture weight concentration of from 0.1% to 5%; and
   the remainder of the base mixture consists essentially of NiO-nickel/iron/oxide.

9. The process of claim 8 wherein copper is present in a weight concentration in excess of 20% of the base mixture.

10. A cermet electrode produced by the process of claim 9.

11. A cermet electrode produced by the process of claim 8.

12. A cermet electrode produced by the process of claim 1.

13. The process of claim 1 wherein the pre-sinter base mixture weight ratio of NiO to nickel/iron/oxide is from 2:3 to 3:2.

14. A cermet electrode produced by the process of claim 13.

15. The process of claim 1 wherein the additional means is present in a base mixture weight concentration of from 0.5% to 1.5%.

16. A cermet electrode produced by the process of claim 15.

17. The process of claim 1 wherein,
   copper is present in a base mixture weight concentration of from 20% to 30%;
   nickel is present in a base mixture weight concentration of from 0.1% to 10%;
   the additional metal is present in a base mixture weight concentration of from 0.5% to 1.5%; and
   the remainder of the pre-sinter base mixture consists essentially of NiO-nickel/iron/oxide in a weight ratio of NiO to nickel/iron/oxide between 2:3 and 3:2.

18. A cermet electrode produced by the process of claim 17.

19. The process of claim 1 wherein,
   copper is present in a base mixture weight concentration of from 10% to 30%;
   nickel is present in a base mixture weight concentration of from 0.1% to 10%;
   the additional metal is present in a base mixture weight concentration of from 0.5% to 5.0%;

the remainder of the pre-sinter base mixture consists essentially of NiO-nickel/iron/oxide; and the additional metal comprises aluminum.

20. A cermet electrode produced by the process of claim 19.

21. The process of claim 1 wherein the metal oxide in the electrode resulting from the additional metal is present in a negligible amount in the finished electrode composition.

22. A cermet electrode produced by the process of claim 21.

23. A process for producing an electrically conductive cermet electrode having an oxide phase and an alloy phase for use in the electrolytic reduction of a metal from a metal compound dissolved in a molten salt, the process comprising the following steps:

combining NiO-nickel/iron/oxide powder with copper and nickel powder to produce a base mixture;

forming the base mixture into a desired shape;

sintering the shaped base mixture to produce a desired NiO-nickel/iron/oxide-Cu-Ni cermit having an oxide phase of NiO-nickel/iron/oxide and an alloy phase of Cu-Ni;

catalyzing the reaction sintering step by including in the base mixture an effective amount of at least one additional metal which reacts to disperse the copper and nickel continuously throughout the NiO-nickel/iron/oxide oxide phase an an alloy to produce a cermet electrode having higher electrical conductivity than were the additional metal not included in the base mixture; and wherein the step of sintering comprises:

raising the temperature to a value just below the melting point of elemental copper, and holding the formed base mixture at such value to allow the copper-nickel alloy to form and stabilize; and then, raising the temperature of the formed base mixture to a sintering temperature.

24. A cermet electrode produced by the process of claim 23.

* * * * *